United States Patent [19]

Uetani et al.

[11] Patent Number: 4,531,616

[45] Date of Patent: Jul. 30, 1985

[54] ELEVATOR CONTROL SYSTEM

[75] Inventors: Kenichi Uetani, Nishi Kasugai County; Yasukazu Umeda, Kasugai, both of Japan

[73] Assignee: Mitsubishi Denki Kabushiki Kaisha, Tokyo, Japan

[21] Appl. No.: 545,194

[22] Filed: Oct. 25, 1983

[30] Foreign Application Priority Data

Nov. 1, 1982 [JP] Japan ..... 57-192126

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 4,044,860 | 8/1977 | Kaneko et al. | 187/29 |
| 4,081,059 | 3/1978 | Kuzunuki et al. | 187/29 |
| 4,244,450 | 1/1981 | Umeda et al. | 187/29 |
| 4,355,705 | 10/1982 | Schröder et al. | 187/29 |
| 4,411,337 | 10/1983 | Schröder et al. | 187/29 |

FOREIGN PATENT DOCUMENTS

| | | |
|---|---|---|
| 51-43551 | 4/1976 | Japan . |
| 57-62179 | 4/1982 | Japan . |
| 57-81069 | 5/1982 | Japan . |
| 57-121571 | 7/1982 | Japan . |

*Primary Examiner*—William M. Shoop
*Assistant Examiner*—W. E. Duncanson, Jr.
*Attorney, Agent, or Firm*—Wenderoth, Lind & Ponack

[57] ABSTRACT

An elevator control system includes one elevator control for each elevator car, one group supervisory device for each floor connected in two ways to the elevator controls, a group supervisory accessory connected to group supervisory devices, and a statistical device connected to the group supervisory devices and also to the group supervisory accessory. The group supervisory accessory calculates a car suspending time interval at each of the forward floors in a direction of travel of the elevator car in accordance with a percentage getting-off or -on from the statistical device by considering car and floor calls and the number of passengers within the elevator car increased due to non-responding floor calls and also a presumed arrival time interval at each floor. The group supervisory devices receive those presumed arrival time intervals to assign the optimum elevator car to the desired floor call through an associated one of the elevator controls.

9 Claims, 17 Drawing Figures

| PERCENTAGE DESTINATION \ GETTING-ON FLOOR | 1F | 2F | 3F | 4F | 5F | 6F | 7F | 8F |
|---|---|---|---|---|---|---|---|---|
| 8F | 15% | 30% | 30% | 35% | 40% | 50% | 100% | |
| 7F | 15% | 20% | 20% | 30% | 40% | 50% | | |
| 6F | 5% | 10% | 10% | 15% | 20% | | | |
| 5F | 25% | 25% | 30% | 20% | | | | |
| 4F | 10% | 10% | 10% | | | | | |
| 3F | 20% | 5% | | | | | | |
| 2F | 10% | | | | | | | |
| 1F | | | | | | | | |

| DISTR NO OF PASS \ GETTING-ON FLOOR | 1F | 2F | 3F | 4F | 5F | 6F | 7F | 8F |
|---|---|---|---|---|---|---|---|---|
| 8F | 0 | 0 | 0 | 1.05 | 0 | 1 | 0 | |
| 7F | 0 | 0 | 0 | 0.9 | 0 | 1 | | |
| 6F | 0 | 0 | 0 | 0.45 | 0 | | | |
| 5F | 0 | 0 | 0 | 0.6 | | | | |
| 4F | 0 | 0 | 0 | | | | | |
| 3F | 0 | 0 | | | | | | |
| 2F | 0 | | | | | | | |
| 1F | | | | | | | | |

ELEVATOR CONTROL SYSTEM

BACKGROUND OF THE INVENTION

This invention relates to an elevator control system for effecting the group supervision of a plurality of elevator cars by estimating presumed arrival time intervals of the elevator cars in response to a floor call or calls. More particularly, the invention concerns an elevator control system arranged to estimate a presumed arrival time interval of each elevator car at each floor of a building served by the elevator cars by predicting car suspending time intervals required for a passenger or passengers to get on the elevator car at a non-responding floor or floors and for the passenger or passengers to get off the elevator car at a forward floor or floors which is or are located in front of that floor at which the passenger or passengers has or have got on the elevator car, in a direction of travel of the elevator car.

Group supervisory elevator systems are arranged to be responsive to the registration of a floor call to select an elevator car most suitable for responding to that floor call on the basis of information required for the group supervision and to assign the floor call to the selected elevator car. Upon the assignment of a floor call, it is required to predict how a car suspending time interval will change due to a car call or calls on the elevator car in operation and a floor call or calls for that elevator car.

To this end, it has been already proposed to effect the predictions in accordance with a percentage destination of getting-on passengers to each floor. More specifically, a load on the elevator car or the number of passengers getting off the elevator car at each floor is predictively calculated by first preparing percentage destinations to forward floors with respect to passengers getting on the elevator car at each floor in each of the directions of travel of the elevator car, and then distributing a predicted number of getting-on passengers due to a floor call at each floor in each of the travel directions in accordance with the percentage destinations to the forward floors, and then effecting the subtraction at each of the forward floors in accordance with an associated one of the resulting distribution ratios.

In the prediction method as described above, it has been required to know data for the percentage destinations to the forward floors for each floor and for each travel direction and also to effect a calculation with respect to all the forward floors for each floor and for each direction resulting in the prolongation of a calculation time. As a result, an elevator car movement has been determined by disregarding a floor call or calls occurring in the calculation. This has resulted in a high possibility of preventing the elevator car from being assigned in comformity with the status quo.

Accordingly, it is an object of the present invention is to provide a new and improved elevator control system for accurately estimating car suspending time interval resulting from a car call or calls and a floor call or calls and capable of easily calculating a presumed arrival time interval of an elevator car at each floor of a building served by the elevator cars within a short data processing time interval.

SUMMARY OF THE INVENTION

The present invention provides an elevator control system for selecting from among a plurality of elevator cars put under the group supervision one elevator car most suitable for responding to a floor call registered on the basis of information required for the group supervision and for assigning the selected elevator car to the floor call which system comprises a calculating means for predicting a car suspending time interval due to a car call and a floor call at each floor served by the plurality of elevator cars in accordance with a percentage of passengers getting-off or -on prepared in each direction of travel of the elevator car with respect to each floor, and a means for calculating presumed arrival time intervals at each floor in consideration of the car suspending time intervals predicted by the calculating means.

In a preferred embodiment of the present invention, the calculating means for predicting the car suspending time interval includes one means for calculating, as a predicted car suspending time interval, one reference time interval required for a single passenger to get off or on and including time intervals required for the elevator car to be accelerated and decelerated and time intervals required associated doors to be opened and closed, and an other means for calculating, as a predicted car suspending time interval, the reference time interval required for each of the passengers excluding one passenger to get off or on which is then multiplied by the number of passengers minus one.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

For a better understanding of the present invention, the description will now be made in conjunction with a conventional predicting system for calculating a predicted load on an elevator car at each floor of a building served by the elevator car and with reference to FIGS. 1, 2 and 3 of the drawings.

Figures 1, 2, 3:
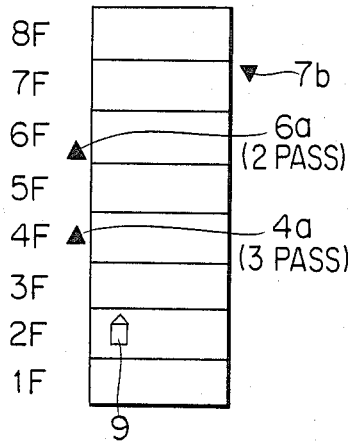
FIG. 1 is a diagram illustrating one example of the relationship between an elevator car and a floor call used with a conventional car loading device for an elevator system.
FIG. 2 is a percentage destination table prescribed to the elevator car shown in FIG. 1 during an up scanning thereof for respective floors shown in FIG. 1.
FIG. 3 is a table indicating distributions of destinations calculated from FIGS. 1 and 2 for respective floors.

In FIG. 1 there is illustrated a plurality of floors, in this case, eight floors 1F, 2F, . . . , 8F of a building served by an elevator car 9 and up floor calls 4*a* and 6*a* at the fourth and sixth floors 4F and 6F assigned to the elevator car 9. Also a down floor call 7*b* exists at the seventh floor 7F.

Assuming that the elevator car 9 is in its up direction, passengers having got-on the elevator car 9 at each floor are predetermined to get off the elevator car 9 at the forward floors in accordance with a percentage destination table shown in FIG. 2. In FIG. 2 each column indicates percentage destinations or destined floors in percent located in front of an associated one of getting-on floors shown in rows and in a direction of travel of the elevator car 9, in this case in the up direction thereof. It will readily be understood that a similar percentage destination table is prescribed to the elevator car during the descent thereof. Those tables have been preliminarily prepared on the basis of data delivered by a statistical device as will be described later.

It is assumed that the elevator car 9 is ascending through the second floor 2F and has the up floor calls 4*a* and 6*a* assigned thereto as shown in FIG. 1. At that time a prediction is effected in terms of the number of passengers getting-on the elevator car 9 at the fourth floor 4F or a percentage load on the elevator car 9; that is, a proportion of the number of getting-on passengers compared to 100 which corresponds to a rated number of passengers in the elevator car 9. Assuming that three passengers are waiting the elevator car 9 at the fourth floor 4F as shown in FIG. 1, it is predicted that three passengers get on the elevator car 9 at the fourth floor 4F. Then, the three at the fourth fourth floor 4F is multiplied by the percentage destinations shown in the column labelled "4F" meaning a getting-on floor. The resulting products are distributed into the forward floors as shown in the column labelled 4F in FIG. 3. For example, a 0.6 passenger is calculated to get off the elevator car 9 at the fifth floor 5F. Also, assuming that two passengers are predicted to get on the elevator car 9 at the sixth floor 6F as shown in FIG. 1, those passengers are distributed to the seventh and eighth floors 7F and 8F respectively as shown in the column labelled "6F" in FIG. 3.

The results of those calculations are stored in a predetermined memory (not shown).

From the foregoing it is seen that $3-0.6=2.4$ passengers remain in the elevator car 9 at the fifth floor 5F and that the remaining passengers at the senth floor 7F is predicted to be of $(2.4-0.45)+2=3.95$ because two further passengers have gotten on the elevator car 9 at the sixth floor 6F. Similarly, the prediction is calculated so that the number of remaining passengers are equal to $(3.95-0.9)-1=2.05$ and $(2.05-1.05)-1=0$ at the seventh and eighth floor 7F and 8F respectively.

In the predicting method as described above, however, it has been necessary to know data concerning the destined forward floors in percent at each of the floors and in each of the directions of travel of the elevator car and to also effect the calculations with respect to all of the forward floors at each floor and in each of the directions of travel of the elevator car, thereby resulting in the prolongation of a calculation time interval.

While FIG. 2 does not show destined floors in percent in the up direction from the eighth floor, it is to be understood that destined floors in percent in a down direction are practically required. Furthermore, for a high building having a multitude of floors, the number of the destined forward floors must increase, thereby resulting in the absolute necessity of using a high capacity memory.

On the other hand, a load on the elevator car is permitted to be predictively calculated only after the number of passengers distributed to each floor has been calculated with respect to all of the floors, as shown in FIG. 3, and the results of the calculations such as 0, 0.6, 0.45, 0.45, . . . shown in FIG. 3 then provided. This has meant that a calculating time interval becomes long and has therefore resulted in a high possibility of the prevention of an associated elevator car from being properly assigned so as to fit the status quo. This is because the elevator car movement is determined by disregarding floor calls occurring during the calculations.

Figure 4:
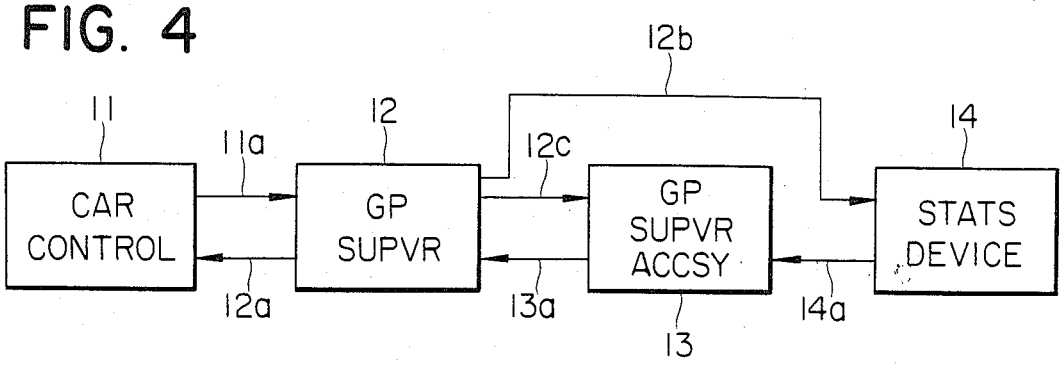
FIG. 4 is a block diagram of one embodiment according to the elevator control system of the present invention with parts omitted.

Referring now to FIG. 4, there is illustrated one embodiment according to the elevator control system of the present invention for effecting the group supervision of a plurality of elevator cars. The illustrated arrangement comprises a car control device 11 for controlling an associated elevator car (not shown) and connected in two ways to a group supervisory device 12. While the single car control device 11 is illustrated, it is to be understood that a plurality of car control devices 11 are actually provided, one for each of the elevator cars. The car control device 11 delivers to the group supervisory device 12 a status-of-car signal 11*a* indicating, for example, a car call, a position of the elevator car, a load on or the number of passengers in the elevator car, a direction of travel of the elevator car or the like while receiving group supervisory data 12*a* such as an assigned floor call or the like from the group supervisory device 12. The group supervisory device 12 delivers a data signal 12*b* required for statistics and a status-of-car signal 12*c*. The signal 12*c* may be the status-of-car signal 11*a* as applied to the group supervisory device 12 or an assigned floor call and is supplied to a group supervisory accessory 13 while the signal 12*b* may be the status-of-car signal 11*a* as applied to the group supervisory device 12 and is supplied to a statistical device 14.

Furthermore, the group supervisory accessory 13 supplies to the group supervisory device 12 presumed data 13*a* such as a presumed load on the elevator car, a presumed arrival time interval of the elevator car at each floor, etc, and the statistical device 14 supplies to the group supervisory accessory 13 a statistical data signal 14*a* corresponding to a percentage of passengers getting-off at each floor, the number of passengers getting-on the elevator car at each floor, etc.

Figure 5A:
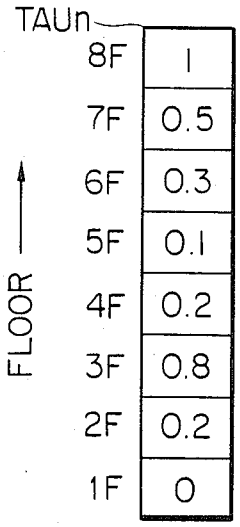
FIGS. 5A and 5B are percentage getting-off tables for the respective floors shown in FIG. 1 illustrating examples of an output from the statistical device shown in FIG. 4.
Figure 5B:
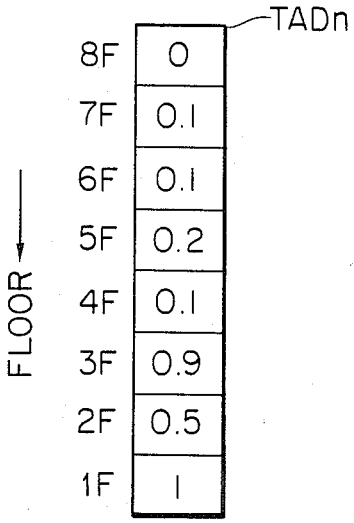
Figure 6A:
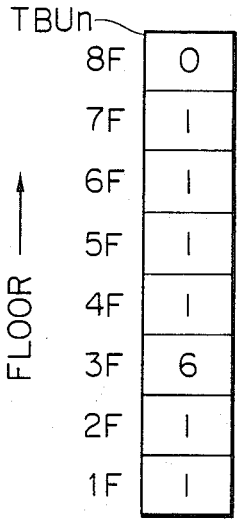
FIGS. 6A and 6B are tables similar to FIGS. 5A and 5B but illustrating the number of getting-on passengers at the respective floors shown in FIG. 1.
Figure 6B:
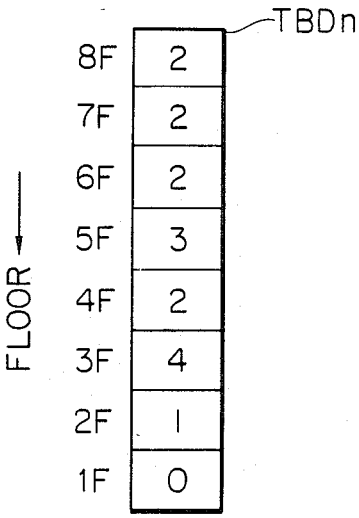

The statistical data signal 14*a* expresses a percentage getting-off TAUn at each floor used with an up scanning and a percentage getting-off TADn at each floor used with a down scanning, as shown in FIGS. 5A and 5B respectively, as well as the number of getting-on passengers TBUn at each floor used with the up scanning and the number of getting-on passengers TBDn at each floor used with the down scanning as shown in FIGS. 6A and 6B respectively where n designates the serial number of the floors which is equally applied to the reference characters as will appear later.

In other words, TAUn or TADn indicates the percentage getting-off at the n-th floor in the up or down scanning. For example, TAU5 has a value of 0.1 indicating the percentage getting-off at the fifth floor in the up scanning. Also, some of undermentioned signals are designated by respective sets of reference characters including one or two n's such as 5 or 5 and 8. Those signals are operatively associated with that floor or floors identified by that n or n's for example 5 or 5 and 8.

Figure 7:
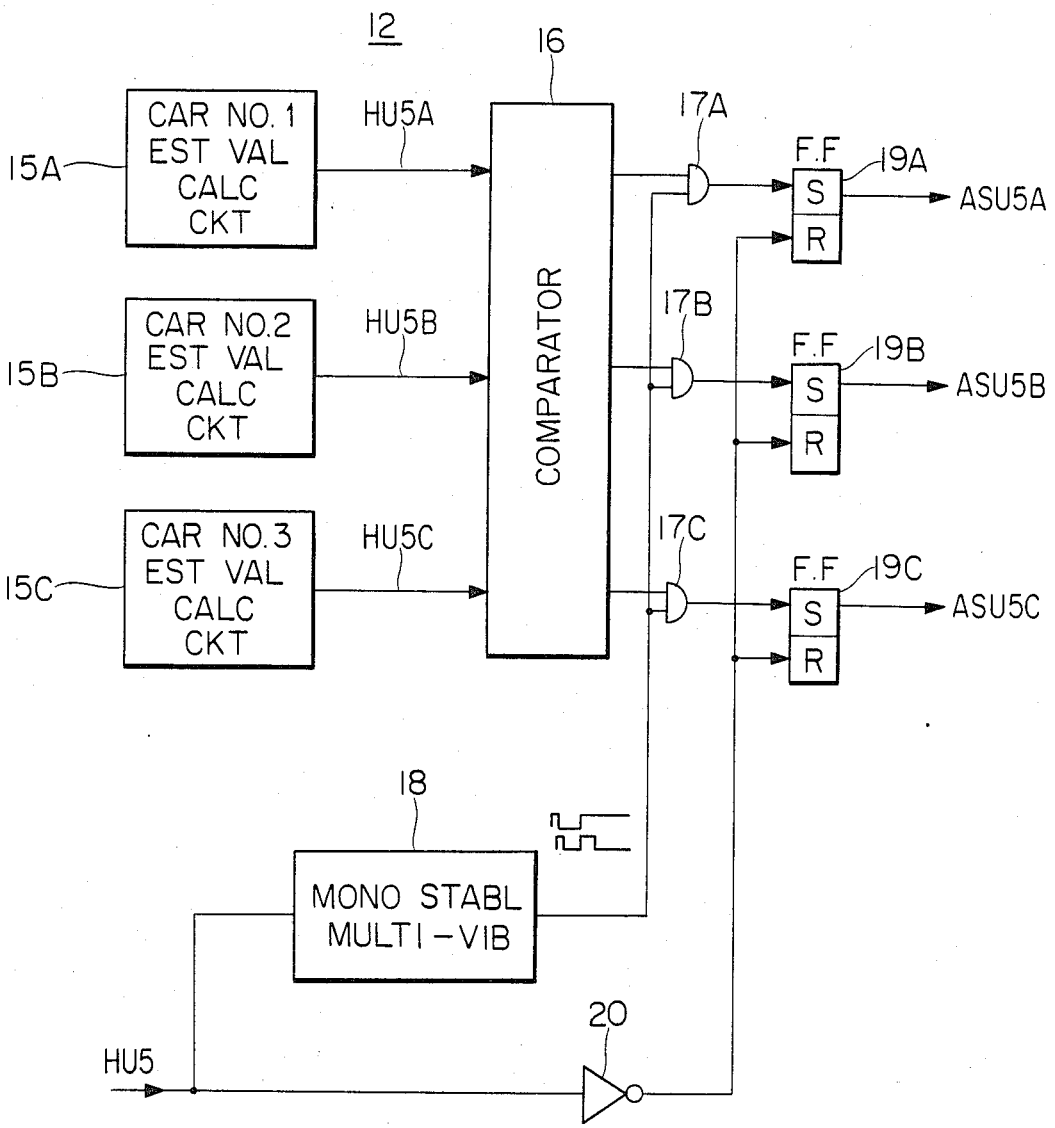
FIG. 7 is a block diagram of the group supervisory device shown in FIG. 4.

The group supervisory device 12 has a circuit configuration as shown in FIG. 7 on the assumption that three elevator cars No. 1, No. 2 and No. 3 (not shown) are controlled by the car control device 11 through the group supervisory device 12 and in response to a floor call at the fifth floor 5F. The illustrated arrangement comprises three estimated value calculating circuits 15A, 15B and 15C for the elevator cars No. 1, No. 2, and No. 3; each circuit calculates an estimated value of an up floor call (not shown) at the fifth floor 5F which is temporarily assigned to an associated elevator car so as to supply an estimated value signal HU5A, HU5B, or HU5C to a comparator 16. The comparator 16 compares those estimated value signals with one another to deliver a signal corresponding to a minimum thereof at its high level to one input of three AND gates 17A, 17B and 17C, one gate being supplied for each of the estimated value calculating circuits 15A, 15B and 15C. The other inputs of the "AND" gates 17A, 17B and 17C are supplied with an output signal from a monostable multivibrator 18. The output signal is put at its high level for a predetermined time interval in response to a register signal HU5 for an up floor call at the fifth floor 5F which is supplied to the monostable multivibrator 18.

The "AND" gates 17A, 17B and 17C outputs are connected to setting terminals of R-S FLIP-FLOP's 19A, 19B and 19C respectively, one FLIP-FLOP being supplied for each of the estimated value calculating circuits 15A, 15B and 15C. Those FLIP-FLOP's have respective resetting terminals supplied with the register signal HU5 which has been inverted by a "NOT" gate 20. When any of the elevator cars No. 1, No. 2 and No. 3 is assigned to the up floor call at the fifth floor, the associated FLIP-FLOP 19A, 19B or 19C produces an assigned up floor call signals ASU5A, ASU5B or ASU5C at its high level. Then, the signal ASU5A, ASU5B or ASU5C is supplied to the group supervisory accessory 13 as the signal 12C.

A group supervisory device similar to that shown in FIG. 7 is provided at each of the remaining floors and supplies a corresponding assigned up floor call signal ASUnA, ASUnB or ASUnC to the group supervisory accessory 13 where n is a value of 1, 2, 3, 4, 6, 7 or 8.

Figure 8:
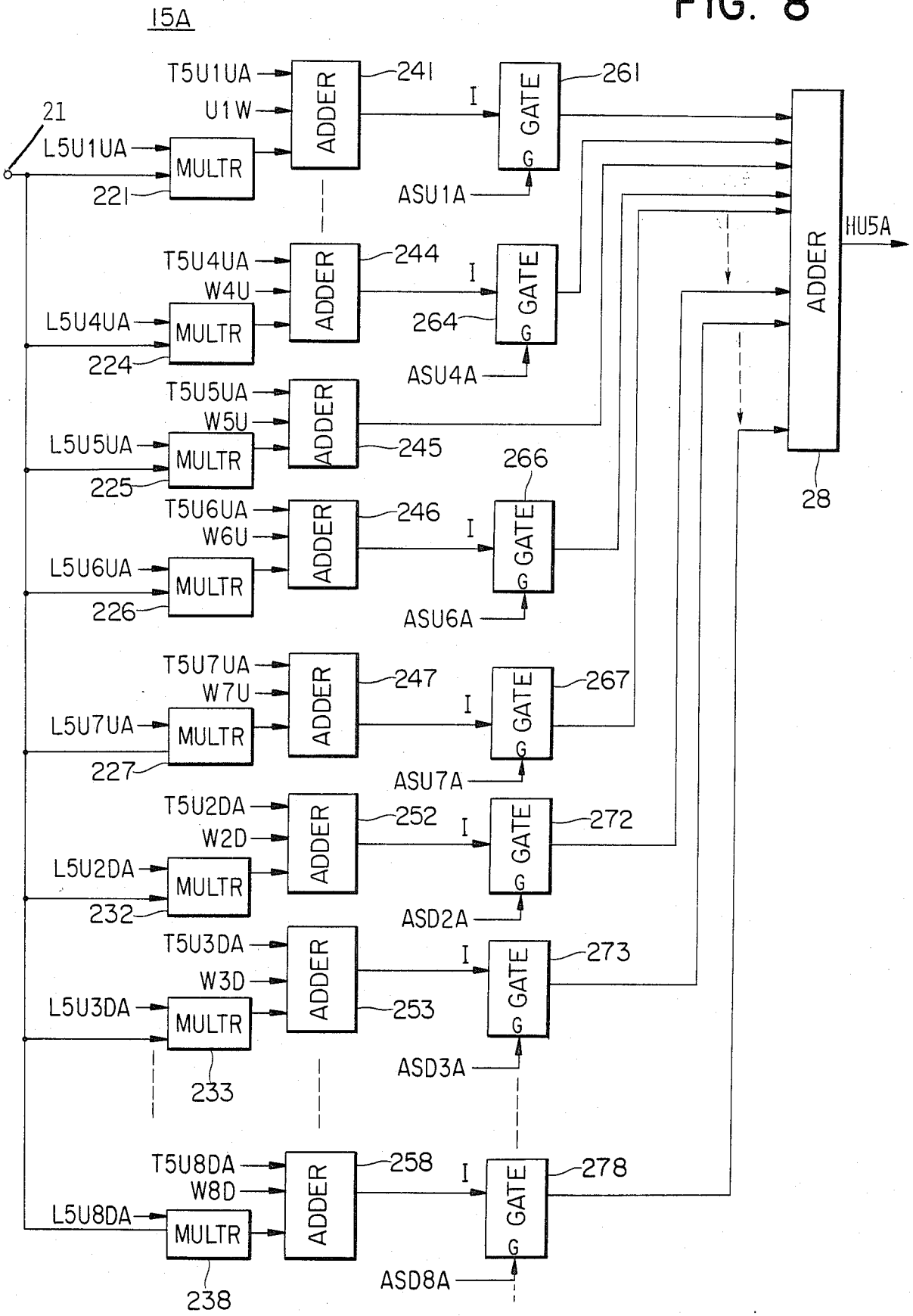
FIG. 8 is a block diagram of an estimated value calculating circuit for calculating an estimated value of an up floor call at the fifth floor temporarily assigned to the elevator car No. 1 shown in FIG. 1.

The estimated value calculating circuits 15A, 15B and 15C are identical to one another and one of them, for example, the circuit 15A, will now be described in detail. FIG. 8 shows the details of the estimated value calculating circuit 15A. The illustrated arrangement comprises an input terminal 21 which receives a fixed value signal indicating a conversion factor for changing a load value to an estimated value, and two sets of multipliers connected together at one end to the input terminal 21. One set thereof has a plurality of multipliers, in this case, seven multipliers 241 through 247 having their other inputs supplied with signals L5U1UA through L5U7UA indicating predicted loads on the elevator car No. 1 when the latter responds to up floor calls at the first through seventh floors after having assigned to the up floor call at the fifth floor so as to multiply the associated predicted load signals by the fixed value signal from the input terminal 21 respectively. The other set of multipliers has a plurality of multipliers, in this case, also seven multipliers 232 through 238 having their other input applied with signals L5U2DA through L5U8DA indicating predicted loads on the elevator car No. 1 when the latter responds to down floor calls at the second through eighth floors after having been assigned to the up floor call at the fifth floor so as to multiply the associated predicted loads signals by the fixed value signal from the input terminal 21 respectively. The products from the multipliers 211 through 227 are supplied to first inputs of adders 241 through 247 while those from the multipliers 232 through 238 are supplied to first inputs of adders 252 through 258. Also, signals W1U through W7U and signals T5U1UA through T5U7UA are shown in FIG. 8 as being supplied to second and third inputs of the adders 241 through 247 respectively while signals W2D through W8D and signals T5U2DA through T5U8DA are similarly supplied to second and third inputs of the adders 252 through 258 respectively. The signals T5U1UA through T5U7UA express respective time intervals at the ends of which the elevator car No. 1 assigned to the up floor call at the fifth floor is presumed to arrive at the first through seventh floors in response to the up floor calls at those floors and the signals T5U2DA through T5U8DA express similar presumed arrival time intervals of the elevator car No. 1 at the second through eighth floors in response to down floor calls at those floors respectively. Also, the signals W1U through W7U express respective waiting times for the up floor calls at the first through the seventh floors at the present stages and the signals W2D through W8D express respective waiting time intervals for the down floor calls at the second through eighth floors at the present stage. When a floor call is not registered, a corresponding waiting time interval at the present stage is equal to zero. The adders 241 through 247 add triads of the signals respectively supplied thereto to one another and deliver the sums to inputs of gate circuits 261 through 267 respectively except for the adder 243. Similarly, the adders 252 through 258 add triads of the three signals respectively supplied thereto to one another and deliver the sums to one input of gate circuits 272 through 278 respectively.

The gate circuits 261 through 268 excluding 265 on the up floor call side have respective G inputs supplied with the assigned up floor calls signals ASU1A through ASU7A at their high level excluding ASU5A as described above in conjunction with FIG. 7 respectively. Similarly, the gate circuits 272 through 278 excluding 275 on the down floor call side have respective G inputs supplied with assigned down floor call signals ASD2A through ASD8A excluding ASD5A put at their high level when the elevator car No. 1 is assigned to down floor calls at the second through eighth floors.

The gate circuits as described above are responsive to the respective assigned floor call signals at their high level supplied to their G inputs so as to deliver input signals I supplied to their inputs to an adder 28.

In FIG. 8, it is noted that the adder 246 is supplied with the signals concerning the fifth floor and is directly connected to the adder 28.

Thus, the adder 28 adds all the input signals I passed through the gate circuits and an input signal from the adder 245 to one another so as to deliver the result of the addition as an estimated value signal HU5A.

The estimated value calculating circuits concerning each of the remaining floors or the first, second, third, fourth, sixth, seventh and eighth floors are similar to the circuit 15A shown in FIG. 8 except for the fact that an adder on each of the up and down floor call sides is supplied with signals concerning the associated floor and is directly connected to the adder 28.

The signal HU5 and the similar signals are supplied to the group supervisory accessory 13 as the signal 12C.

Figure 9:
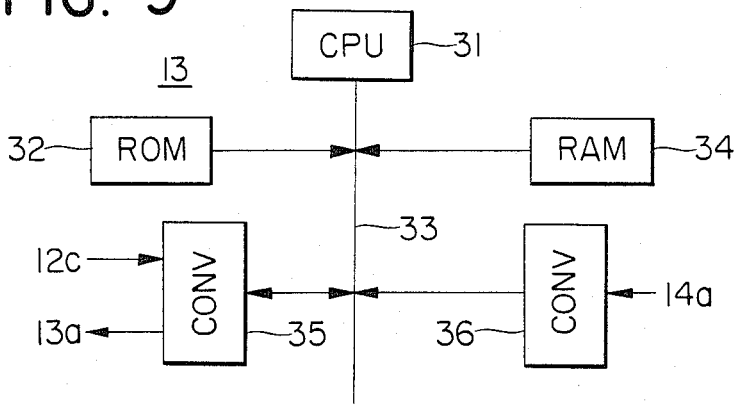
FIG. 9 is a block diagram of the group supervisory accessory shown in FIG. 4.

The group supervisory accessory 13 may be of a circuit configuration such as shown in FIG. 9. The illustrated arrangement comprises a central processing unit 31, a read only memory (which is abbreviated hereinafter as an "ROM") 32 connected to the central processing unit 31 through a bus 33 and a random access memory (which is abbreviated hereinafter as an "RAM") also connected to the central process unit 31 through the bus 33. The ROM 32 has stored therein the programs shown in FIGS. 11 through 15 and fixed value data and the RAM 34 is enabled to write and read data processed by the central processing unit 31 into and from storing addresses therein. Furthermore, two converters 35 and 36 are connected to the central processing unit 31 through the bus 33. The converter 35 is operative to convert the status-of-car signal 12*c* such as an assigned floor call, or the status of the elevator car, to information capable of being processed by the central processing unit 31 and to also convert the results of the processing conducted by the central processing unit 31 to the presumed data 13*a* such as the presumed load on the elevator car at each floor, the presumed arrival time interval of the elevator car at each floor, etc. The converter 36 is operative to convert the statistical data signal 14*a* such as the percentage of the passengers within the elevator car getting-off to information capable of being processed by the central processing unit 31.

Figure 10:
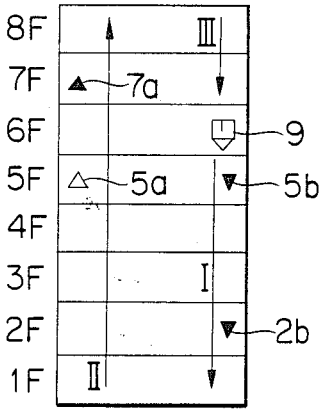
FIG. 10 is a diagram illustrating the relationship between an elevator car and floor calls useful in explaining the operation of the arrangement shown in FIG. 9.

It is now assumed that, as shown in FIG. 10, an up floor call 7*a* at the seventh floor designated by the symbol "black triangle" has been assigned to the elevator car 9 identified by No. 1 and shown between the seventh and fifth floors, and an assigned up floor call 5*a* at the fifth floor designated by the symbol "white triangle" is not yet assigned to that elevator car while assigned down floor calls 5*b* and 2*b* designated by inverted black triangles exist at the fifth and second floors.

The operation of the embodiment of the present invention will now be described in conjunction with FIG. 4. When the car control device 11 issues the status-of-car signal 11*a*, the group supervisory device 12 responds to that signal to so as temporarily assign the associated elevator car (not shown) to the particular floor call and to deliver the status-of-car signal 12*c* to the group supervisory accessory 13 while delivering the data signal 12*b* required for statistics to the statistical device 14. The statistical device 14 is in the well known from, for example, Japanese laid-open patent application No. 62,179/1982 and is operative to store a ratio of the number of passengers getting-off in response to a car call (of a load) to the number of passengers getting-on up to that floor to which the car call has been registered or to a percentage getting-off for each floor in each of the directions of travel of the elevator car. For example, the statistical device 14 has stored therein the percentage getting-off tables TAUn and TADn used with the up and down scanning as shown in FIGS. 5A and 5B respectively. Those tables can be prepared on the basis of the data signals 12*b* required for statistics and received thereby during the past several days. Also, the statistical device 14 has similarly stored therein the number of passengers having gotten on in response to a floor call and the number of floor calls at each floor in each of the directions of travel of the elevator car. In other words, the number of getting-on passengers is determined by a ratio of the number of the getting-on passengers to the number of the floor calls at each floor in each of the travel directions and stored in the statistical device 14 as the tables of the number of getting-on passengers TBUn and TBDn used with the up and down scannings as shown in FIGS. 6A and 6B respectively.

The stored data as described above are delivered to the group supervisory accessory 13 as the statistical data signal 14*a*. Then, the group supervisory accessory 13 calculates a predicted load on the elevator car and a presumed arrival time interval of the elevator car at each floor from the signals 12*c* and 14*a* supplied thereto so as to deliver them to the group supervisory device 12. The latter device 12 generates and applies the group supervisory data 12*a* to the car control device 11 so that the group of elevator cars are operated by good service while the elevator cars are prevented from being full of passengers and to pass through any floor or floors It is now assumed that, as shown in FIG. 10, the elevator car No. 1 designed by the reference numeral 9 is descending through the sixth floor 6F and has the up floor call 7*a* at the seventh the floor 7F, the down floor call 5*b* at the fifth floor 5F and the down floor call 2*b* at the second floor 2F assigned thereto. At that time, it is assumed that the up floor call 5*a* at the fifth floor 5F has been registered.

When information as described above is delivered to the group supervisory accessory 13 as the status-of-car signal 12*c*, the latter is entered into the central processing unit 31 through the converter 35. On the other hand, the statistical signal 14*a* from the statistical device 14 is entered into the central processing unit 31 through the converter 36. Then, the central processing unit 31 executes a program stored in the ROM 22 to deliver and receive signals to and from the RAM 34 resulting in the initiation of a scanning calculation as shown in FIGS. 11, 12 and 13.

Figure 11:
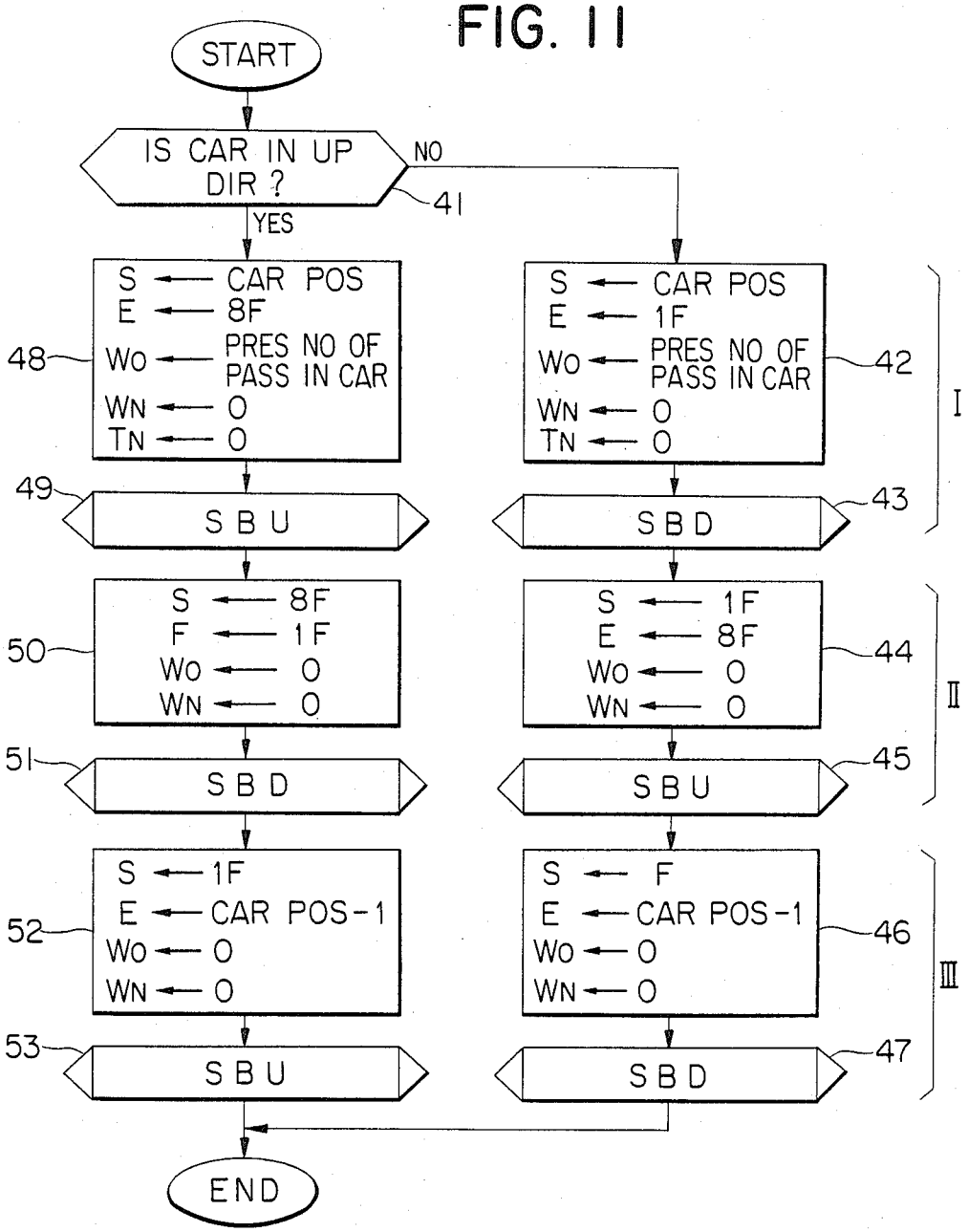
FIG. 11 is a flow chart for programming the operation of the arrangement shown in FIG. 9.
Figure 12A:
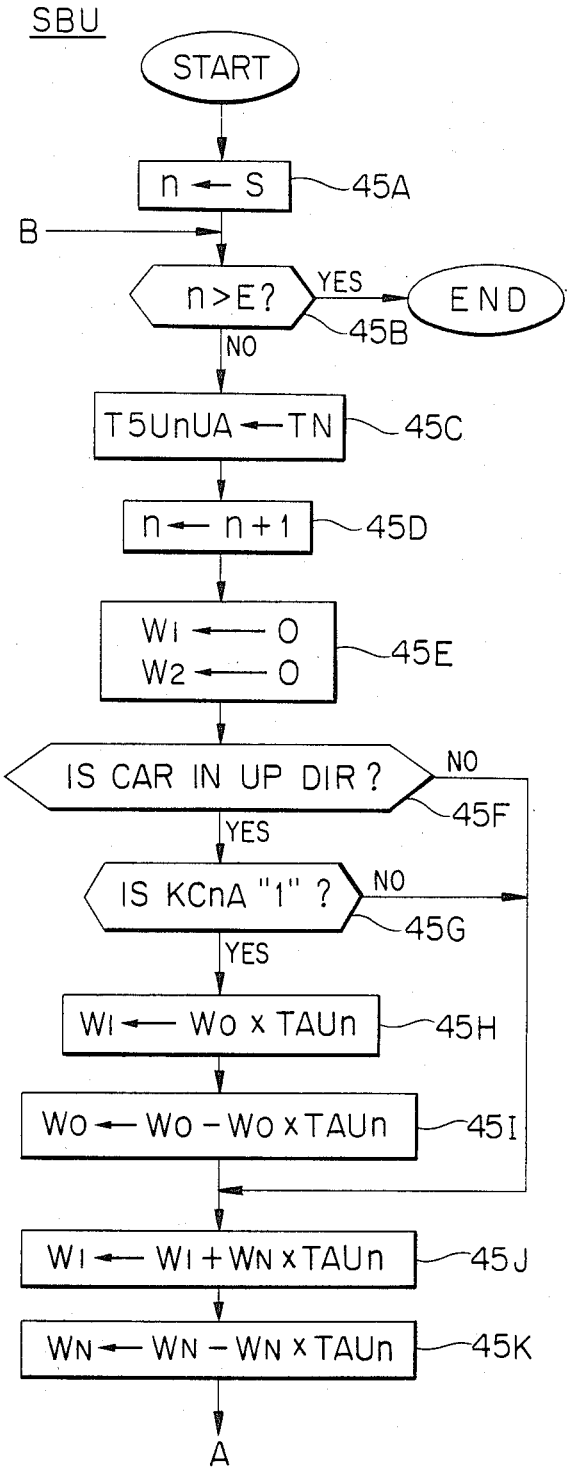
FIGS. 12A and 12B are combined with each other to illustrate a flow chart for executing the steps of procedure of the subroutine SBU shown in FIG. 11.
Figure 12B:
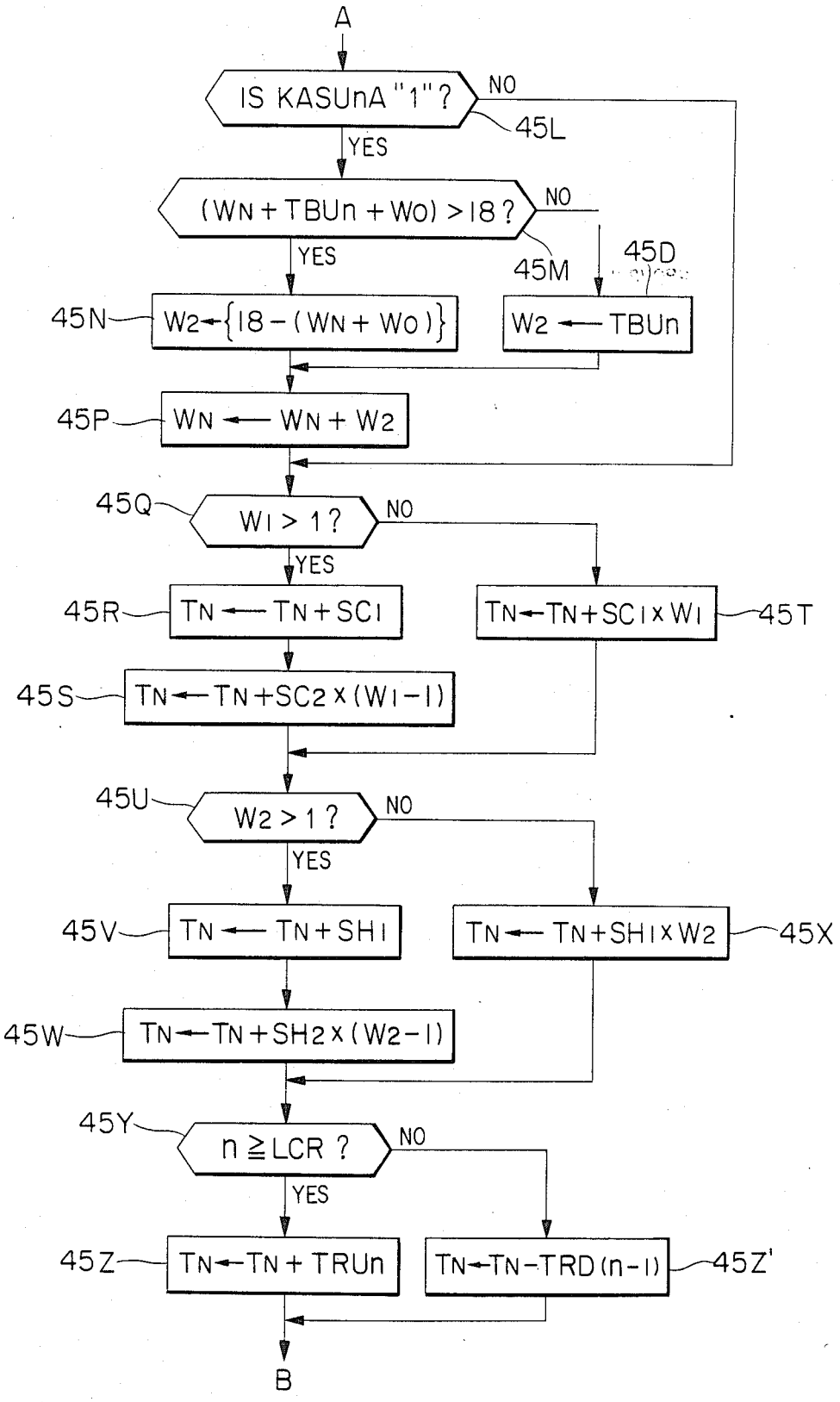

FIG. 11 shows a program for calculating a presumed arrival time interval of the elevator car No. 1 when the up floor call 5*a* has been temporarily assigned to the elevator car No. 1. FIGS. 12A and 12B show the details of the subroutine SBU, as illustrated in FIG. 11, used with the up scanning and FIGS. 13A and 13B show the details of the subroutine SBD, as illustrated in FIG. 11, used with the down scanning.

In FIG. 11, the program starts at the uppermost block labelled "START" and then the step 41 determines if the elevator car 9 is in its up direction. Since the elevator car 9 is descending as assumed above, the step 41 goes to the step 42. In the step 42, a scan starting floor S is set to that floor at which the elevator car 9 is located. In this example, the floor S is set to the sixth floor 6F. Also, a scan ending floor E is set to the first floor. Furthermore, a residual value $W_o$ of the initial number of passengers within the elevator car 9 at each floor is set to the present number of passengers within the elevator car 9 and a residual value $W_N$ of the number of passengers within the elevator car increased due to a non-responding floor call at each floor is set to zero. In addition, a presumed cumulative arrival time $T_N$ is set to zero. Then, the step 43 is entered to execute the subroutine SBD used with the down scanning, as shown in FIGS. 13A and 13B.

Figure 13A:
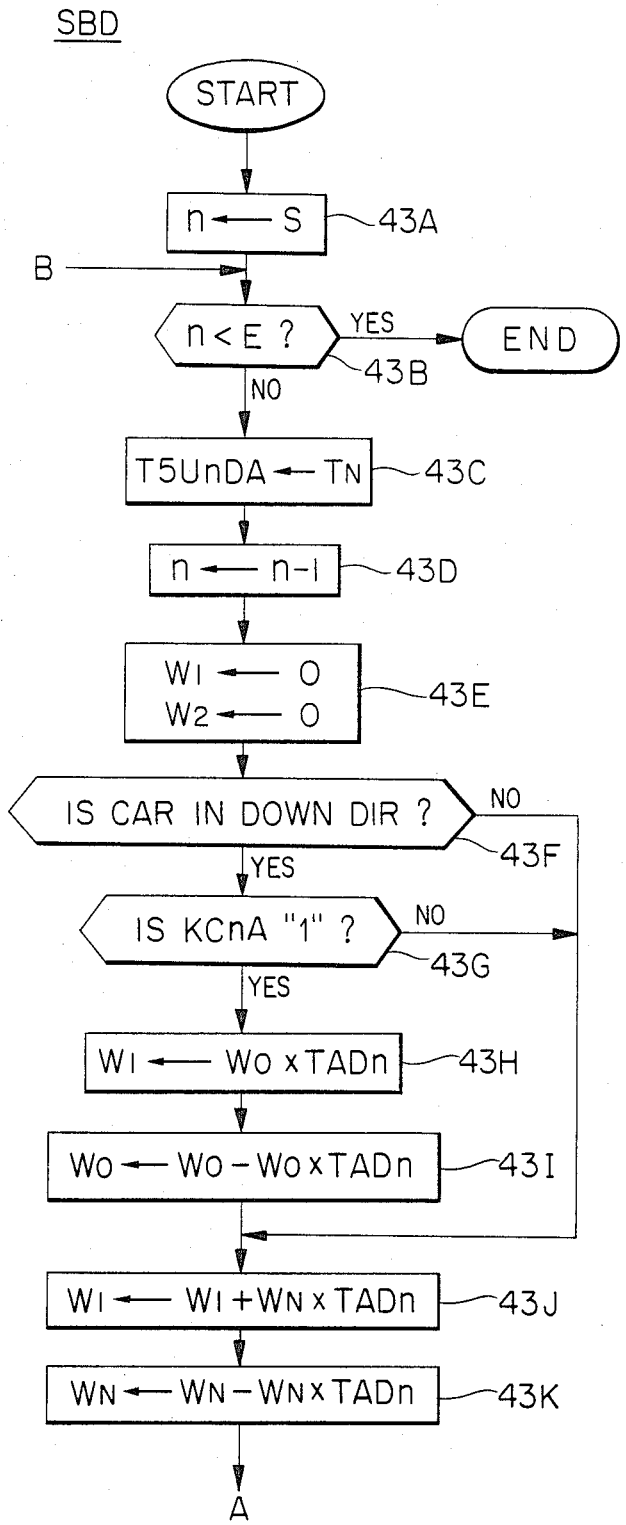
FIGS. 13A and 13B are a flow chart similar to FIGS. 12A and 12B but illustrating the subroutine SBD shown in FIG. 11.
Figure 13B:
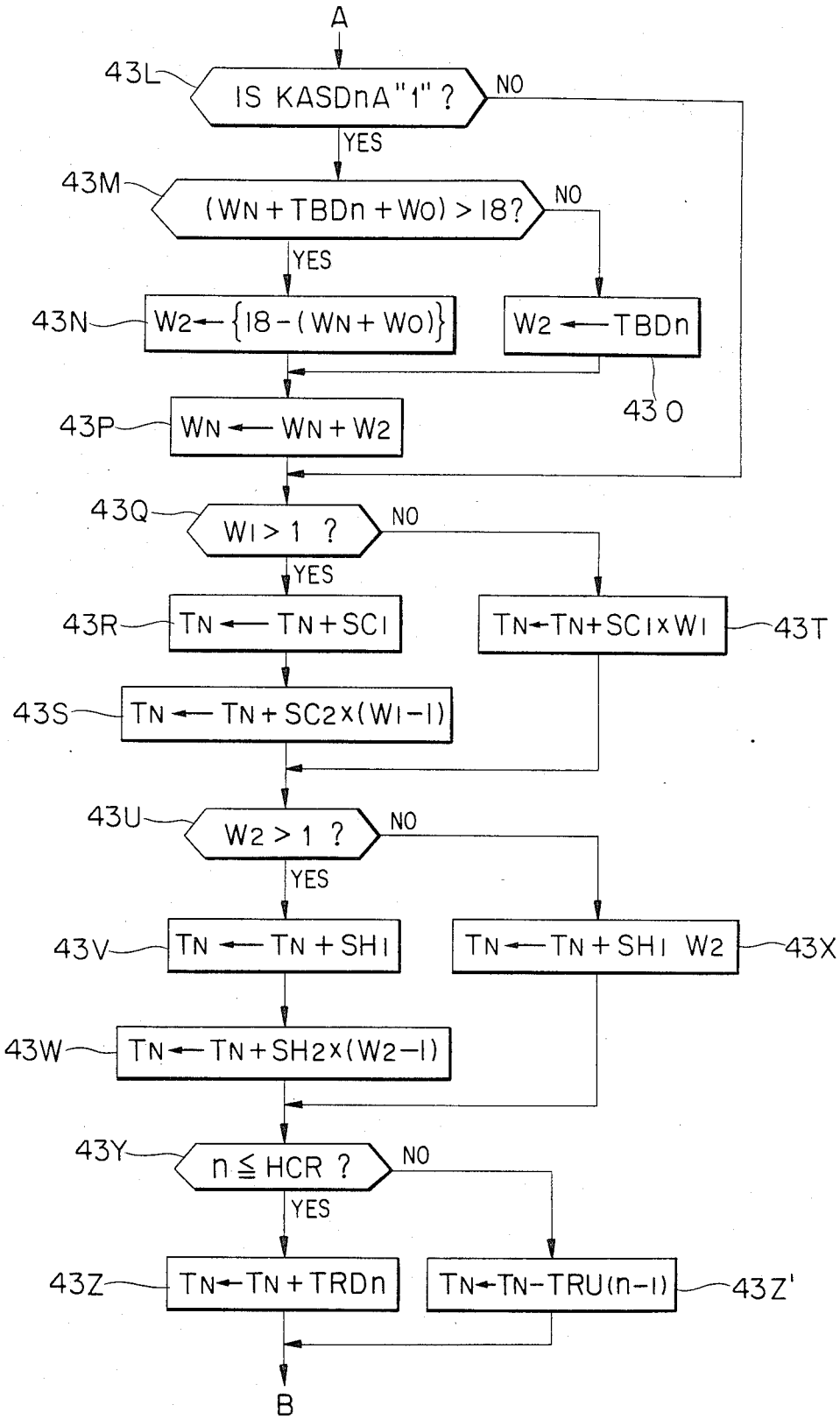

In the subroutine SBD, starting with the uppermost block labelled "START" as shown in FIG. 13A, the step 43A sets a floor n to the scan starting floors and then the step 43B determines if the floor n is smaller than the scan ending floor E. If it is so determined in the step 43A, then the down scanning is ended as shown by the block labelled "END" in FIG. 13A, the block being located to the right of the step 43B.

When the floor n is not smaller than the floor E as determined in the step 43B, the step 43C stores in the RAM 34 a presumed arrival time interval $T_N$ at the scanned floor obtained up to the preceding scan as a presumed arrival time interval T5UnUA at the n-th floor in the down direction.

In the next succeding step 43D, n+1 is substituted for n so as to update a scanned floor. Then, the step 43F first sets the number of getting-off passengers w1 at the scanned floor of the passengers initially getting-on the elevator car and the increased number of passengers within the elevator car due to non-responding floor calls to zero, and also sets the number of passengers within the elevator car at the scanned floor which has increased due to non-responding floor calls to zero. The next succeeding step 43F determines if the elevator car 9 is in the down direction. When it is so determined in the step 43F, the step 43G determines if a car call signal KCnA is of a binary ONE, that is to say, whether the car call signal is present. When the step 43G determines the presence of the car call signal, the program goes to the step 43H where the percentage getting-off table TADn for the down scanning is used to calculate the number of getting-off passengers w1 at the scanned floor in accordance with the residual value $W_o$ of the initial number of passengers within the elevator car. Then, in the step 43I, $W_o - W_o \times TADn$ is calculated. That is, the residual value $W_o$ of the initial number of passengers within the elevator car is decreased in accordance with the percentage getting-off table TADn for the down scanning to again set a residual value W of the initial number of passengers within the elevator car at that time.

After the residual value $W_o$ has been again set in the step 43I, the step 43J is entered to calculate $w1 + W_N \times TADn$. That is, the step 43J calculates the number of getting-off passengers at the scanned floor n due to the increased number of passengers resulting from non-responding floor calls from the percentage getting-off table TADn and adds the calculated number to the number of getting-off passengers at the scanned floor so as to set the number of getting-off passengers w1 to newly set the number of getting-off passengers w1.

When each of the steps 43F and 43G gives an answer "NO", it goes directly to the step 43J.

In the next suceeding step 43K, $W_N - W_N \times TADn$ is calculated to again set a $W_N$. In other words, the residual value $W_N$ of the increased number of passengers within the elevator car due to non-responding floor calls is decreased in accordance with the percentage getting-off table TADn so as to thereby again set a $W_N$.

The step 43K goes to the step 43L as shown by the reference character A in FIGS. 13A and 13B. The step 43L determines whether a down floor call signal KASDnA such as 5*b* or 2*b* at the fifth or second floor 5F or 2F which has been temporarily assigned to the elevator car 9 is present. That is, the step 43L determines if that signal is of a binary ONE. When the down floor call signal GASDnA is of a binary ONE or present as determined in the step 43L, the step 43M determines if $(W_N + TBDn + W_o)$ is greater than 18 where 18 designates a full capacity of the elevator car 9. That is, the step 43M determines if a passenger or passengers getting-on at the down scanned floor results in the full capacity of the elevator car. When the step 43M determines that the full capacity is not reached, the program goes to the step 43N where $18 - (W_N + W_o)$ is calculated to determine the number of passengers permitted to get on at the scanned floor to reach the full capacity of the elevator car. That is, the step 43N sets the increased number w2 of passengers within the elevator car at the scanned floor. On the other hand, when the full capacity is reached as determined in the step 43M, the step 43O sets the value $TBD_N$ of the table of the number of getting-on passengers for the down scanning to w2.

After the w2 has been set in the step 43N or 43O, the step 43P is entered where the number of passengers w2 getting-on at the scanned floor is added to the increased residual value $W_N$ of passengers within the elevator car so as to update the residual value $W_N$. Thereafter, the step 43Q determines if the number w1 of passengers getting-off at the scanned floor is greater than one.

It is noted that when the step 43L gives an answer "NO", it directly advances to the step 43Q.

When one or more passengers has or have got off at the scanned floor as determined in the step 43Q, the step 43R is entered where a reference time intervals SC1 required for one passenger to get off (which involves a deceleration, and an acceleration time interval of the elevator car and door opening and closing time intervals therefor) is added to the presumed cummulative arrival time interval $T_N$ to update the $T_N$. In the next succeeding step 43S, a presumed cumulative arrival time interval $T_N$ is again set by multiplying a reference time interval SC2 required for each passenger to get off by the number of the remaining getting-off passengers w1−1 and adding the resulting product to the presumed arrival time interval $T_N$ added to the reference time interval SC1. It is noted that reference time interval SC2 does not include the reference time interval SC1.

When the step 43Q determines that w1>1 does not hold, the step 43T is entered to add the presumed cumulative arrival time interval $T_N$ to the reference time interval SC1 multiplied by the number of getting-off passengers w1 at the scanned floor so as to set a presumed cumulative arrival time interval $T_N$.

The steps 43Q, 43R and 43S or the steps 43Q and 43T form a procedure flow for calculating a car suspending time intervals due to the number of getting-off passengers.

The step 43S or 43T is followed by a procedure flow including the steps 43U, 43V and 43W or the steps 43U and 43X to calculate car suspending time intervals due to the number of getting-on passengers. The steps 43U, 43V, 43W and 43X are identical in procedure to the steps 43Q, 43R, 43S and 43T respectively except for the fact that reference time intervals SH1 and SH2 required for the getting-on are substituted for the reference intervals SC1 and SC2 respectively and the number w2 of getting-on passengers is used in place of the number w1 of getting-off passengers. The reference time interval SH1 includes time intervals required for the elevator car to be accelerated and decelerated and time intervals required for associated doors to be open and closed. For example, the step 43U determines if $w2>1$ holds and the step 45W adds a presumed cumulative arrival time interval $T_N$ to the reference time interval $SHS_2$ multiplied by the number of remaining getting-on passengers $w2-1$ so as to set a presumed cumulative arrival time interval $T_N$. At that time, the procedure flow for the car suspending time interval due to the number of getting-on passengers has been completed.

Then, a procedure flow for an inter-floor travel time interval starts with the step 43Y which determines if the scanned floor n has exceeded the lowermost change floor HCR. If it is so determined in the step 43Y, then the step 43Z adds to the presumed cumulative arrival time interval $T_N$ to an inter-floor travel time interval read out from an inter-floor time table TRDn (not shown) for the down scanning stored in the statistical device 14 as an increment so as to newly set a new presumed cumulative arrival time interval $T_N$. On the other hand, when the scanned floor n did not exceed the lowermost change floor HCR as determined in the step 43Y, the step 43Z' subtracts an inter-floor travel time interval TRD $(n-1)$ (not shown) similarly read out from the statistical device 14 from the presumed cumulative arrival time interval $T_N$ so as to set a new presumed cumulative arrival time interval $T_N$.

Either of the steps 43Z and 43Z' is returned back to the step 43B (FIG. 13A) as shown by the reference character B in FIGS. 13A and 13B so as to repeat the process as described above until the step 43B determines that $n<1F$ holds. At that time, the program for the down scanning is completed. That program is also denoted by the Roman reference numeral I in FIGS. 10 and 11.

Following the step 43, the step 44 (see FIG. 11) is entered so as to set a scan starting floor S to the first floor 1F, and so as to set a scan ending floor E to the eighth floor 8F. Furthermore, the step 44 sets an initial number of passengers within the elevator car to zero (because all the passengers have got off when the elevator car reaches the first floor 1F) and the increased number of passengers within the elevator car due to non-responding floor calls is set to zero. Then, the subroutine SBU used with the up scanning is executed. The subroutine SBU starts with the uppermost block labelled "START" in FIG. 12A and sets a floor n to the scan starting floor S in the step 45A. Then, step 45B determines if the scanned floor n is larger than the scan ending floor E. If so, then the subroutine is ended as shown by a block labelled "END" denoted adjacent to the step 45B. On the other hand, when the scanned floor n is not larger than the scan ending floor E as determined in the step 45B, the step 45C is entered so as to store in the RAM 34 a presumed arrival time interval $T_N$ at the now scanned floor obtained in the preceding scanning as a presumed arrival time interval T5UnUA at the scanned floor n in the up direction. The next succeeding step 45D updates the scanned floor n by setting $(n+1)$ equal to n. Then, the step 45E sets the number of getting-on passengers w1 at the scanned floor of the initial number of passengers within the elevator car and the increased number of passengers within the elevator car due to non-responding floor calls to zero and also sets the increased number of passengers w2 within the elevator car due to the non-responding floor calls to zero. Subsequently, the step 45F determines if the elevator car is in its up direction. If it is so determined in the step 45F, the step 45G determines if a car call signal KCnA is of a binary ONE. In other words, the step 45G determines whether the car call signal, is present. In the presence of the car call signal as determined in the step 45G, the step 45H calculates the number of getting-off passengers w1 at the scanned floor due to the residual value $W_o$ of the initial number of passengers within the elevator car from a percentage getting-off table TaUn (not shown) used with the up scanning. Then, the step 45I calculates $W_o-W_oX$ TAUn, that is to say, decreases the residual value $W_o$ of the initial number of passengers within the elevator car in accordance with the percentage getting-off table TAUn for the up scanning to again set a residual value $W_o$ of the initial number of passengers within the elevator car. The next succeeding step 45J calculates $w1+W_N+$TAUn. That is, the step 45J adds to the the number of getting-off passengers w1 at the scanned floor n, the product of a residual value$_N$ of the recreased number of passengers within the elevator car due to the non-responding floor calls multiplied by the percentage getting-off table TAUn to newly set the number of getting-off passengers w1.

When either of the steps 45F and 45G gives an answer "NO", the program goes directly to the step 45J.

The following step 45K calculates $W_N-W_N\times$TAUn. That is, the step 45K decreases the residual value $W_N$ of the increased number of passengers within the elevator car due to the non-responding floor calls in accordance with the percentage getting-off table TAUn so as to newly set that $W_N$.

Then, the step 45K goes to the step 45L as shown by the reference character "A" in FIG. 12A and 12B. The step 45L determines if a temporarily assigned up floor call signal KASUnA is of a binary ONE. In other words, the step 45L determines whether that signal is present. In the presence of the signal KASUnA, as determined in the step 45L, the step 45M is entered to determine if $(W_N+TBDn+W_o)$ is greater than 18, where 18 designates the full capacity of the elevator car 9. That is, the step 45M determines if a passenger or passengers getting-on at the up scanned floor results in the full capacity of the elevator car. When the step 45M determines that the full capacity is not reached, the program goes to the step 45N where $18-(W_N+W_o)$ is calculated so as to determine the number of passengers permitted to get on at the scanned floor so as to reach the full capacity of the elevator car. That is, the step 45N sets the increased number of passengers w2 within the elevator car at the scanned floor.

On the other hand, when the full capacity is reached, as determined in the step 45M, the step 45O sets the value of the table TBDn of the number of getting-on passengers for the upper scanning to w2.

Either of the steps 45N and 45O goes to the step 45P where the number of passengers w2 getting-on at the scanned floor is added to the residual value $W_N$ of the number of passengers increased within the elevator car so as to update the residual value $W_N$. Thereafter, the step 45Q determines if the number of passengers getting-off at the scanned floor is larger than one.

It is noted that when the step 45L gives an answer "NO", it directly advances to the step 45Q.

When one or more passengers has or have got off at the scanned floor as determined in the step 45Q, the step 43R is entered where a reference time intervals SC1 required for one passenger to get off (which involves a deceleration, and an acceleration time interval of the elevator car and door opening and closing time intervals therefor) is added to the presumed cumulative arrival time interval $T_N$ to update the $T_N$. In the next succeeding step 45S, the presumed cumulative arrival time interval $T_N$ is again set by multiplying a reference time intervals SC2 required for each passenger to get off by the number of the remaining getting-on passengers $w1-1$ and adding the resulting product to the presumed arrival time interval $T_N$ added to the reference time interval SC1. It is noted that the reference time interval SC2 does not include the reference time interval SC1.

When the step 45Q determines that $w1>1$ does not hold, the step 45T is entered so as to add the presumed cumulative arrival time interval $T_N$ to the reference time interval SC1 multiplied by the number of getting-off passengers w1 so as to set a presumed cumulative arrival time interval $T_N$.

The steps 45Q, 45R and 45S or the steps 45Q and 45T form a procedure flow for calculating a car suspending time interval due to the number of getting-off passengers.

The step 45S or 45T is followed by a procedure flow including the steps 45U, 45V and 45W or the steps 45U and 45X to calculate car suspending time intervals due to the number of getting-on passengers. The steps 45U, 45V, 45W and 45X are identical in procedure to the steps 45Q, 45R, 45S and 45T respectively except for the fact that reference time intervals SH1 and SH2 required for the getting-on are substituted for the reference intervals SC1 and SC2 respectively and the number of getting-on passengers w2 at the scanned fooor is used in place of the number of getting-off passengers w1. For example, the step 45U determines if $w2>1$ holds and the step 45W adds a presumed cumulative arrival time interval $T_N$ to the reference time interval $SHS_2$ multiplied by the number of the remaining getting-on passengers $w2-1$ so as to set a presumed cumulative arrival time interval $T_N$. At that time, the procedure flow for the car suspending time interval due to the number of getting-on passengers has been completed.

Then, a procedure flow for an inter-floor travel time intervals starts with the step 45Y which determines if the scanned floor n has exceed the lowermost change floor LCR. If it is so, as determined in the step 45Y, the step 45Z adds to the presumed cumulative arrival time interval $T_N$ an inter-floor travel time interval read out from an inter-floor time table TRUn (not shown) for the up scanning stored in the statistical device 14 as an increment so as to set a new predumed cumulative arrival time interval $T_N$. On the other hand, when the scanned floor n did not exceed the lowermost change floor LCR, determined in the step 45Y, the step 42Z' subtracts an inter-floor travel time interval TRU $(n-1)$ (not shown) similarly read out from the statistical device 14 from the presumed cumulative arrival time interval $T_N$ so as to set a new presumed cumulative arrival time interval $T_N$.

Either of the steps 42Z and 42Z' is returned back to the step 45B (FIG. 12A) as shown by the reference characters B in FIGS. 13A and 13B so as to repeat the process as described above until the step 45B determines that $n<1F$ holds. At that time, the program for the up scanning is completed. The program is denoted by the Roman reference numeral II shown in FIGS. 10 and 11.

Following this, the step 46 (see FIG. 11) is entered so as to set a scan starting floor S to the eighth floor 8F, and so as to set a scan ending floor E to that floor located immediately above the position of the elevator car in this case, the seventh floor because the elevator car is located at the sixth floor and one floor located on the upper side of the cars' position is the seventh floor 7F. Furthermore each of the $W_o$ and $W_N$ is set to zero. Then, the subroutime SBD designated by the reference numeral 47 is executed. That subroutime 47 is identical to the subroutime 43 as described above in conjunction with FIGS. 13A and 13B. When the step 43B determines that $n<7$ holds, a program including the step 46 and the subroutime 47 is executed. The program is denoted by the Roman reference number III in FIGS. 10 and 11. Also, the program starting with step 41 and described above is also executed as shown by the lowermost block as shown in FIG. 11 labelled "END".

Assuming that the step 41 determines that the elevator car 9 is in its up direction, the step 48 is entered to set the scan starting floor E, the scan ending floor E, $W_o$, $W_N$ and $T_N$ in the same manner as the step 42. Then, the subroutine SBU designated by the reference numeral 49 is executed. Th subroutine 49 is identical to the subroutime SBU shown in FIGS. 12A and 12B.

After the completion of the program following the subroutine 49, the step 50 sets the S, E, $W_o$ and $W_n$ in the same manner as the step 44 excepting that the scan starting floor S is set to the eighth floor 8F and the scan ending floor E is set to the first floor 1F. The next succeeding step 51 executes the subroutime SBD shown in FIGS. 13A and 13B.

Then, the step 52 sets the E, $W_o$ and w1 in the same manner as the step 46 except for the fact that the scan starting floor S is set to the first floor but not to the eighth floor. Following this, the step 53 executes the subroutime SBU shown in FIGS. 12A and 12B. When the subroutine SBU has been executed, the program shown in the lefthand column in FIG. 11 is completed as shown at the lowermost block labelled "END" in FIG. 11.

While the flow chart has been described in conjunction with the elevator car No. 1, it is to be understood that the same is equally applicable to the remaining elevator cars No. 2 and No. 3.

The group supervisory accessory 13 delivers the predicted load-on-car signals L5U1UA through L5U-7UA and L5U2DA through U5U8DA for the elevator car No. 1, which has been calculated as described above, to the group supervisory device 12 through the converter 35. Those signals are multiplied by the fixed value from the terminal 21 by means of the multipliers 221 through 227 and 232 through 238 respectively, as shown in FIG. 8.

On the other hand, the group supervisory accessory 13 calculates the presumed arrival time signals T5U-1UA through T5U7UA indicating respectively arrival time intervals for which the elevator car No. 1 is presumed to arrive at the corresponding floors in response to up floor calls at the first through seventh floors; the presumed arrival time signals T5U2DA through T5U8DA respectively indicate the arrival time intervals for which the elevator car No. 1 is presumed to arrive at the corresponding floors in response to down floor calls at the second through eighth floors respectively, the waiting time signals W1U through W7U for the up floor calls at the first through seventh floors respectively, and the waiting time signals W2D through W8D for the down floor calls at the second through eighth floors.

As described above in conjunction with FIG. 8, the presumed arrival time signals T5U1UA through T5U-7UA, and the waiting time signals W1U through W7U are added to each other by the adders 421 through 247 along with the outputs from the associated multipliers 221 through 226. Similarly, the presumed arrival time signals T5U2DA through T5n8DA and the waiting time signals W2D through W8D are added to each other by the adders 252 through 258 along with the outputs from the associated multipliers 232 through 238. The output from the adders 245 is directly supplied to the adder 28. Also, the outputs from the adders 247, 255 and 252 are supplied to the adder 28 through the mating gate circuits 267, 275 and 272 because those gate circuits permit the outputs from the mating adders to pass therethrough in response to the assigned floor call signals ASU7A, ASD5A and ADS2A supplied thereto.

The adder 28 adds the signals supplied thereto to one another so as to deliver the estimated value signal HU5A to the comparator 16 (see FIG. 7).

The calculations as described above are effected in conjunction with the elevator cars No. 2 and No. 3 and the adder 28 delivers to the comparator 16 the estimated value signals U5B and U5C resulting from these calculations.

As described above in conjunction with FIG. 7, the comparator 16 selects a minimum of the estimated value signals HU5A, HU5B and HU5C and delivers the selected signal at its high level. The delivered signal is designated by the reference character HU5. It is now assumed that the delivered signal HU5 results from the elevator car No. 1.

Under these circumstances, the registered up floor call signal 5*a* at the fifth floor 5F is put in its high level. At that time, the output from the monostable multivibrator 18A is put at its high level for the predetermined time interval so as to put the output from the "AND" gate 17A at its high level so as to thereby set the FLIP-FLOP or memory 19A. Thus, the memory 19A delivers the assigned up floor call signal ASU5A at the fifth floor for the elevator car No. 1 at its high level.

From the foregoing it is seen that the car suspending time interval or intervals due to a car call or calls directed to the forward floor or floors and the car suspending time interval or intervals due to a floor call or calls at the forward floor or floors can be predicted and the predicted suspending time intervals are assigned to one of the elevator car after having been combined with the corresponding estimated value. Thus, the presumed arrival time interval at each floor is accurately obtained, thereby resulting in good service.

When the elevator car 9 responds to the fifth floor, the up floor call signal 5*a* is released so as to be put at its low level. Thus, the output from the "NOT" gate 20 is inverted so as to be put at its low level, thereby resulting in the resetting of the memory 19A. Therefore, the assigned up floor call signal ASU5A is put at its low level.

While the description has been made in conjunction with the assignment of the up floor call 5*a* at the fifth floor, it is to be understood that it is equally applicable to the assignment of an up or a down floor call at any of the floors other than the fifth floor.

From the foregoing it is seen that, the present invention calculates the number of passengers getting-off an elevator car at each of the forward floors in accordance with a percentage of passengers getting-off preliminarily prepared and presumes a car suspending time intervals at each of the forward floors in accordance with the calculated number of getting-off passengers (said number not always being an integer). This measure is possible to presume an accurate suspending time interval due to a car call and a floor call with a small amount of calculating data within a short calculating time interval.

Also, since the suspending time interval due to the number of getting-off passengers and the number of getting-on passengers are calculated from the number of passengers, a presumed arrival time interval at each floor can be accurately calculated.

While the present invention has been illustrated and described in conjunction with a single preferred embodiment thereof, it is to be understood that numerous changes and modifications may be resorted to without departing from the spirit and scope of the present invention. For example, the percentage getting-off tables TAUn and TADn have been described as being provided by the statistical device 14. It is to be understood that those tables may be replaced by fixed values suited to the particular building.

What is claimed is:

1. An elevator control system for selecting from amoung a plurality of elevator cars put under the group supervision one elevator car most suitable for responding to a floor call registered on the basis of information required for the group supervision and assigning said selected elevator car to said floor call, which system comprises a calculating means for predicting a car suspending time interval due to a car call and a floor call at each floor served by said plurality of elevator car in accordance with a percentage of passenger getting-off or -on preliminarily prepared in each direction of travel of the elevator car with respect to each floor, and a means for calculating presumed arrival time intervals at each floor in consideration of said suspending time interval predicted by said calculating means; wherein said calculating means for predicting the suspending time interval calculates a predicted suspending time interval on the basis of the number of getting-off passengers calculated from passengers within the elevator car which has increased due to non-responding floor calls in accordance with a percentage getting-off at each floor.

2. An elevator control system for selecting from among a plurality of elevator cars put under the group supervision one elevator car most suitable for responding to a floor call registered on the basis of information required for the group supervision and assigning said selected elevator car to said floor call, which system comprises a calculating means for predicting a car suspending time interval due to a car call and a floor call at each floor served by said plurality of elevator car in accordance with a percentage of passengers getting-off or -on preliminarily prepared in each direction of travel of the elevator car with respect to each floor, and a means for calculating presumed arrival time intervals at each floor in consideration of said suspending time interval predicted by said calculating means; wherein said calculating means for predicting the suspending time interval includes a first means for calculating a predicted suspending time interval for the number of getting-off passengers which is not larger than a predetermined magnitude and a second means for calculating a predicted suspending time interval for the number of getting-off passengers which is not smaller than the predetermined magnitude.

3. An elevator control system as claimed in claim 2, wherein said first means delivers a first reference time interval required for a single passenger to get off.

4. An elevator control system as claimed in claim 3, wherein said first reference time interval includes time intervals required for the elevator car to be accelerated and decelerated and time intervals required for associated doors to be opened and closed.

5. An elevator control system as claimed in claim 2, wherein said second means delivers, as car suspending time interval, a second reference time interval required for each of said passengers excluding one passenger to get off.

6. An elevator control system for selecting from among a plurality of elevator cars put under the group supervision one elevator car most suitable for responding to a floor call registered on the basis of information required for the group supervision and assigning said selected elevator car to said floor call, which system comprises a calculating means for predicting a car suspending time interval due to a car call and a floor call at each floor served by said plurality of elevator car in accordance with a percentage of passengers getting-off or -on preliminarily prepared in each direction of travel of the elevator car with respect to each floor, and a means for calculating presumed arrival time intervals at each floor in consideration of said suspending time interval predicted by said calculating means; wherein said calculating means for predicting the suspending time interval includes a first means for calculating a predicted car suspending time interval for the number of getting-on passengers which is not larger than a predetermined magnitude and a second means for calculating a predicted car suspending time interval for the number of getting-on passengers which is not smaller than the predetermined magnitude.

7. An elevator control system as claimed in claim 6, wherein said first means delivers a first reference time interval required for a single passenger to get on.

8. An elevator control system as claimed in claim 7, wherein said first reference time interval includes time intervals required for the elevator car to be accelerated and decelerated and time intervals required for associated doors to be opened and closed.

9. An elevator control system as claimed in claim 6, wherein said second means delivers, as a car suspending time interval, a second reference time interval required for each of said passengers excluding one passenger to get on.

* * * * *